US007927683B2

(12) United States Patent
Katayama

(10) Patent No.: US 7,927,683 B2
(45) Date of Patent: Apr. 19, 2011

(54) WEAK ACID BAR SOAP WITH WATERPROOF PROTECTIVE FILM

(75) Inventor: Yaeko Katayama, Fukui (JP)

(73) Assignees: Yacko Katayama, Tokyo (JP); Yoriko Katayama, Fukui-shi (JP); Tomonori Murai, Fukui-shi (JP); Yudai Murai, Fukui-shi (JP); Tomohiro Yuki, Washinton, DC (US)

( * ) Notice: Subject to any disclaimer, the term of this patent is extended or adjusted under 35 U.S.C. 154(b) by 283 days.

(21) Appl. No.: 11/488,916

(22) Filed: Jul. 19, 2006

(65) Prior Publication Data

US 2008/0020177 A1 Jan. 24, 2008

(51) Int. Cl.

| | |
|---|---|
| ***B44C 1/16*** | (2006.01) |
| ***B65D 75/28*** | (2006.01) |
| ***C11D 9/04*** | (2006.01) |
| ***C11D 17/00*** | (2006.01) |
| ***C11D 17/04*** | (2006.01) |

(52) U.S. Cl. ..... 428/121; 206/77.1; 428/96; 428/98; 510/141; 510/142; 510/147

(58) Field of Classification Search ..... 428/121, 428/98, 96; 252/92; 206/77.1; 510/141, 510/142, 147

See application file for complete search history.

(56) References Cited

U.S. PATENT DOCUMENTS

| | | | | |
|---|---|---|---|---|
| 4,273,684 | A * | 6/1981 | Nagashima et al. | 510/147 |
| 4,297,228 | A * | 10/1981 | Kamada et al. | 510/142 |
| 6,107,262 | A * | 8/2000 | Noble, II | 510/147 |
| 6,336,553 | B1 * | 1/2002 | Gordon | 206/77.1 |

FOREIGN PATENT DOCUMENTS

| | | | | |
|---|---|---|---|---|
| JP | S55-146455 | | | 4/1979 |
| JP | S55-25465 | | | 2/1980 |
| JP | S58-163544 | | | 10/1983 |
| JP | S61-76600 | | | 4/1986 |
| JP | S61-233100 | | | 10/1986 |
| JP | 10292200 | A | * | 11/1998 |
| JP | 3064487 | U | | 9/1999 |
| JP | 2002-161300 | A | | 6/2002 |
| JP | 3581959 | P | | 8/2004 |
| JP | 2006199807 | A | * | 8/2006 |

OTHER PUBLICATIONS

English translation of JP 2006199807 A (Katayama) (see above).*
Translation of JP 10292200 A (Hirachan), see above.*

* cited by examiner

*Primary Examiner* — Brent T O'Hern

(74) *Attorney, Agent, or Firm* — Westerman, Hattori, Daniels & Adrian, LLP

(57) ABSTRACT

A weak acid bar soap including a body having N-long-chain acyl acidic amino-acid salt, water, and a transparentizing agent and having a shape which has at least base and side; a waterproof protective film attached to lower side surface of said weak acid bar soap. The waterproof protective film is a little bigger than said base of said weak acid bar soap and covers all of said base, extending to a lower part of said side continuously from said base, attached to said lower side surface of said weak acid bar soap to cover at least said lower part of said side, leading edge of said waterproof protective film and said side of said weak acid bar soap are clung tightly to nor make a gap, such that said base and said lower part of said side of said weak acid bar soap are not dissolved by moisture.

18 Claims, 14 Drawing Sheets

WEAK ACID BAR SOAP WITH WATERPROOF PROTECTIVE FILM

BACKGROUND OF INVENTION

The present invention relates to a weak acid bar soap (super-transparent bar soap) with a waterproof protective film capable of preventing excessive dissolution while in use and capable of preventing local dissolution when set on a soap stand or the like, especially preventing adhesion to a soap stand or the like by dissolved soap.

The term "soap" includes a variety of soap types, and there have recently been popularized and used transparent or semi-transparent bar soaps with patterns or pressed flowers embedded therein for imparting a decorative effect. For example, Japanese Unexamined Utility Model Publication No. 55-146455 relates to "a patterned soap" including a transparent bar soap with a character or pattern embedded therein. Japanese Unexamined Utility Model Publication No. 58-163544 relates to "a composite soap" in which various color bar soaps are combined.

Japanese Unexamined Patent Publication No. 61-76600 relates to "an advertising soap" in which a sheet of printed paper or a printed resin film is sandwiched between a transparent or semi-transparent bar soap and a base made of a lightweight material, such as a foamed synthetic resin or the like, and combined using an adhesive. Japanese Unexamined Patent Publication No. 61-233100 relates to "a transparent soap set with a plant" which includes a transparent soap having a low melting temperature and at least one plant such as a crude drug, a potpourri, or a flower in an original form or a crushed form.

Japanese Utility Model Registration No. 3064487 relates to "a soap with a pressed flower" in which a pressed flower is added as a decoration to the surface or the inside of a bar soap body. In the soap with the pressed flower, a plant such as a pressed flower or the like is embedded in the soap. However, the bright color of the plant changes to reduce the effect as a decorative art soap. The color changes due to contact with air, but also the color changes before the flower is embedded in the soap or during the embedding step. Moreover, the color also changes due to soap components after embedding.

The inventor of this application also filed an application for patent entitled "Decorative Art Soap" on Apr. 2, 2002, and the application was registered on Aug. 6, 2005 (Japanese Patent No. 3581959). This patent relates to a decorative art soap including "a transparent weak acid soap and a tridimensional dry plant embedded therein, wherein the weak acid soap is controlled to pH 6 or less, and the dry tridimensional plant is controlled to substantially the same pH as that of the soap."

In the decorative art soap disclosed in Japanese Patent No. 3581959, the embedded dry plant is controlled to substantially the same pH as that of the weak acid transparent soap, and thus the embedded dry plant never changes in color, thereby maintaining the effect as an art soap.

Also, the inventor filed another application for patent entitled "Decorative Art Soap" on Nov. 29, 2000 (Japanese Unexamined Patent Publication No. 2002-161300). This application relates to pinching some parts of ornamental portion between two transparent films at least one side of which is spread with adhesive, making an ornamental sheet, which is embedded into the bar soap.

Said "Decorative Art Soap" which is disclosed in Japanese Unexamined Patent Publication No. 2002-161300 is made by a more convenient operation than embedding each ornamental portion separately, because each ornamental portion such as dried flower or the like is embedded inside or on a surface of a bar soap as a ornamental sheet. Furthermore, the ornamental portion inside of the ornamental sheet will not change its color for long time because it is completely sealed with the transparent film, and air cannot come in.

Then, weak acid bar soaps are used preferably for these bar soaps which have an ornamental nature, so that the ornaments look beautiful. For example, "transparent solid detergent" which disclosed in Japanese Unexamined Patent Publication No. 55-25465 is known as a composition of the weak acid bar soaps.

[Patent Document 1]
Japanese Unexamined Utility Model Publication No. 55-146455
[Patent Document 2]
Japanese Unexamined Utility Model Publication No. 58-163544
[Patent Document 3]
Japanese Unexamined Patent Publication No. 61-76600
[Patent Document 4]
Japanese Unexamined Patent Publication No. 61-233100
[Patent Document 5]
Japanese Utility Model Registration No. 3064487
[Patent Document 6]
Japanese Patent No. 3581959.
[Patent Document 7]
Japanese Unexamined Patent Publication No. 2002-161300
[Patent Document 8]
Japanese Unexamined Patent Publication No. 55-25465

PROBLEMS TO BE SOLVED BY THE INVENTION

Weak acid bar soaps which have good transparency and can be enjoyed for the beauty of their appearance, and need to function as normal soaps. However, weak acid bar soaps have some problems when they are actually used as soaps.

First, weak acid bar soaps have a property to dissolve in water very easily. Therefore the soap not only dissolves excessively when used, but also dissolves due to contact with moisture during storage, and thus the soap is wasted. Furthermore, dissolved weak acid bar soaps have a property as a strong adhesive because of acid-amino acid, and they may deform onto a surface of a soap stand and harden. Thus, there is problem that the base of the weak acid bar soap adheres to a soap stand strongly if it was put in a place where there is a lot of moisture. To tear off the bar soap is almost impossible, and the weak acid bar soap itself will crumble or break if it is torn off by force.

At paragraph [0018] of Japanese Unexamined Patent Publication No. 2002-161300 described above, it is disclosed to put a ornamental sheet on a bottom of a soap and the ornamental sheet has a function as a receiving dish. However, the inventor of this application found that the problem cannot be solved by a soap has an ornamental sheet on the bottom. The reason will be explained by using FIG. 1A to FIG. 1E.

FIG. 1A shows a soap which is weak acid bar soap 1 attached on its base 2 to an ornamental sheet 3. The ornamental sheet 3 is made by two sheets and ornament 10, which is pinched between those two sheets, and size of the ornamental sheet 3 is almost same as the base 2. FIG. 1A shows an initial normal shape of the soap in which the ornamental sheet 3 is attached. In FIG. 1B, a portion of the side 4 of the normal shape weak acid bar soap 1 is dissolved with time by moisture on a soap stand or the like to form a recess 5. FIG. 1C shows the state in which it is dissolved more and the recess 6 of the side 4 is enlarged. However, actually it does not dissolve evenly like FIG. 1C. Sometimes it dissolves unevenly as shown in FIG. 1D, so the beauty is spoiled and the commercial value is reduced. FIG. 1E shows the state in which the weak acid bar soap is dissolved further and the whole shape of the weak acid bar soap 1 is decreased in size with time. As described above, there is a problem that the part between the ornamental sheet 3 and the lower part of the side 4 of the weak acid bar soap 1 comes into contact with moisture on a soap stand, and the recesses 5, 6 are made because the lower part of the side 4 is dissolved, then the soap dissolves more from those parts.

That is, even if the ornamental sheet 3 is attached to the base, it can prevent dissolving only in the center portion of the base to which it is attached, and it cannot prevent dissolving of the area around the lower portion of the side 4. Furthermore, as shown in FIG. 1F, there is the problem that the dissolved weak acid bar soap 1 hardens on the surface of the soap stand 7 and makes the layered adhesion layer 8, 8, these adhering the soap stand 7 and the weak acid bar soap 1 completely by adhesive effect. Thus the problem is not solved that the weak acid bar soap 1 cannot be pulled away from the soap stand 7, and the weak acid bar soap 1 becomes useless.

As described above, conventional ornamental weak acid bar soaps have problems. These are accordingly prevented if the weak acid bar soaps are dried completely whenever they are used. However, this is inconvenient for soaps for mass consumption. Even so, the dissolution cannot be prevented completely if the soap is in a place with high moisture like a bathroom. These are the problems to be solved by the invention. It is an object of the invention to provide weak acid bar soaps capable of preventing excessive dissolution during use and local dissolution under set on a soap stand.

MEANS FOR SOLVING THE PROBLEMS

The weak acid bar soap of the invention is attached to a waterproof protective film which is a little bigger than the base of the soap. The waterproof protective film is attached to cover not only the whole base but also a portion of the lower part of the side at least. That is, the outer circumference of the waterproof protective film attached to the base of the weak acid bar soap is stood up and stuck to the side of the weak acid bar soap. It is not good if the leading edge of the waterproof protective film is away from the side of the weak acid bar soap, because the weak acid bar soap will dissolve by moisture which accumulates in the gap. It is needed that the leading edge of the waterproof protective film is in close contact with the weak acid bar soap to avoid making a gap.

The height of the waterproof protective film clung to the side from the base of the soap is preferably set around 5 mm 7 mm. In such a case, the waterproof protective film needs to be shaped around 5 mm to 7 mm larger than the outer circumference of the soap. For example, if the weak acid bar soap is shaped into a cylinder, the waterproof protective film shall be shaped into a circle which has around 5 mm to 7 mm larger radius than the base's radius.

The weak acid bar soap of the invention is composed with N-long-chain acyl acidic amino-acid salt, water, and a transparentizing agent (at least one of multiple alcohols, hydrocarbon, thiourea, and urea) as mandatory components. Washing and foaming assistant component (fatty acid soap or the like), fragrance, pigment, plant extract, and the other components (collagen, hyaluronate sodium, or the like) can be added. In addition, the transparency of this weak acid bar soap is a similar degree as transparent glass.

The waterproof protective film is overhung on the side of the weak acid bar soap, so it occasionally injures the human body if too thick a film is used. Then, polyethylene film is especially suitable for its material, and it is preferred that the thickness is between 30 μm and 40 μm or less.

If information such as characters, patterns, figures or the like is printed or added on the waterproof protective film, it can be seen from the front face of the weak acid bar soap. It is acceptable that the weak acid bar soap of the invention is stuck and clung to the ornament or the ornamental sheet which pinches the ornament, and the size of the ornament or the ornamental sheet is the same or less than the base. Then the waterproof protective film is stuck and clung to either the ornament or the ornamental sheet from above. In addition, the sheet which is pinches and seals the ornament, such as pressed flowers or printed material, between two polypropylene films is preferable as the ornamental sheet.

Furthermore, it is also acceptable that the sheet which is pinches and seals the ornament, such as pressed flowers or printed material, between two polypropylene films is used as the waterproof protective film, made in larger size than the base of the weak acid bar soap and clung to the side. With regard to this polypropylene film, it is also acceptable that one of the two films which clings to the weak acid bar soap is made in the same size or smaller size than the base of the soap, and another film, which is made in a little bigger size than the base of the soap, is attached to cover the side portion of the soap and clings to it.

In addition, for example, if the weak acid bar soap is shaped other than cylinder, it is better that the waterproof protective film is stand up and sticks to the height of the soap where the cross-section has the maximum external diameter.

ADVANTAGEOUS EFFECT OF THE INVENTION

The weak acid bar soap of the invention will not dissolve from the lower part of the side of the soap and will not make a recess due to dissolving, because from its base to a portion of the side is covered with the waterproof protective film. That is, the waterproof protective film is stuck and clung to the surface of the soap, so moisture will not enter from a gap and the weak acid bar soap will not partially dissolve and become distorted. Therefore, the weak acid bar soap of the invention dissolves evenly from the top surface, so it can be used effectively to the end and there is no wasteful consumption of the soap. Furthermore, soap stands and the soap will not stick to each other, so the soap can be handled and used by hand without difficulty. Furthermore, if thin film having a thickness of between 30 μm and 40 μm or less is used as the waterproof protective film, it is safe because it does not injure the human body.

BEST MODE FOR CARRYING OUT THE INVENTION

Embodiment

FIG. 2A shows the first embodiment of the weak acid bar soap of the invention. Element 1 of this drawing is the weak acid bar soap and element 11 is the waterproof protective film. The weak acid bar soap 1 is shaped into cylinder, and each of FIGS. 2A and 2B show a sectional view. The base 2 is attached to the waterproof protective film 11. As illustrated in FIG. 2A, the weak acid bar soap includes an upper surface opposite the base 2 and two side surfaces 4 connecting the base 2 and the upper surface. As illustrated in FIG. 2A, a leading edge of the waterproof protective film 11 is attached to the side surface of the body of the weak acid bar soap 1. As illustrated in FIG. 2A, the upper surface and a portion of the side surface 4 of the body of the weak acid bar soap 1 is exposed and not covered by the waterproof protective film 11.

N-long-chain acyl acidic amino-acid salt, water, and a transparentizing agent (at least one of multiple alcohols, hydrocarbon, thiourea, and urea) are used for the weak acid bar soap 1 as mandatory component and washing and foaming assistant component (fatty acid soap or the like), fragrance, pigment, plant extract, and the other components (collagen, hyaluronate sodium, or the like) can be added. This transparent bar soap may be colored or colorless, and an ornament which has fanciness may be embedded in it.

The transparency of this weak acid bar soap 1 is the same degree as a transparent glass. In addition, the weak acid bar soap 1 has cubic liquid crystal structure including micelle, i.e. a sphere-shaped collection of washing components, aligns like crystal, so it has a transparent appearance and is highly hydrophilic and dissolving in water very easily.

In this embodiment, polyethylene film is used as the waterproof protective film 11. Polyethylene film has good bendability, so if polyethylene film is used for the waterproof protective film 11, there is an advantage that it can be attached to the weak acid bar soap 1 easily without adhesive in the manufacturing process. Furthermore, polypropylene film allows for relieving an uncomfortable feeling that occurs when the soap is used, especially by the leading edge of the waterproof protective film 11, because polyethylene film is thin. Further, it does not injure the human body and is safe when it is used because of polyethylene film's slenderness. In addition, thickness between 30μ and 40μ or less is best for this polyethylene film.

The waterproof protective film 11 is cut and prepared into 5~7 mm larger size than the base 2 of the weak acid bar soap 1. Then, it is preferred that the outer circumference of the waterproof protective film 11 is, for example, cut into undulant form to increase affinity with the weak acid bar soap 1. Then, the waterproof protective film 11 is attached to the base 2. The part of the waterproof protective film 11 which extends 5~7 mm beyond the base of the soap is stood up for and clung to the side 4 of the weak acid bar soap 1.

At this point, the waterproof protective film 11 made by polyethylene can be clung to the weak acid bar soap 1 in dry conditions without adhesion by sticking with pressure, and it does not come unstuck. In this situation, as shown in FIG. 2B, it is not good if the leading edge of the waterproof protective film 11' is away from the side 4 of the weak acid bar soap 1, because the weak acid bar soap 1 will dissolve by moisture which is accumulated in the gap. It is needed that the leading edge of the waterproof protective film is clung to the side to avoid making a gap. Not only to protect the weak acid bar soap 1 but also to give it fanciness, it is good to print on one side of the waterproof protective film 11 which is attached firmly to the base 2 of the weak acid bar soap 1.

In this way, the weak acid bar soap 1 will not dissolve from the base or the lower part of the side 4 of the soap and will not form a recess, because from its base 2 to a portion of the side 4, it is covered with the waterproof protective film 11. Therefore, soap stands and the soap will not stick to each other, so the soap can be handled and used by hand without difficulty. Thus, waste of the soap is eliminated.

The uncomfortable feeling that occurs when the soap is used is relieved, because the waterproof protective film 11 made by polyethylene film having great flexibility is attached. Furthermore, the film 11 does not injure the human body and is safe when it is used. Furthermore, manufacturing is easy because the waterproof protective film 11 can be attached to the weak acid bar soap 1 without adhesion.

FIG. 3 shows the second embodiment of the weak acid bar soap of the invention. Element 1 of this drawing is the weak acid bar soap, element 11 is the waterproof protective film, and element 3 is the ornamental sheet. In this second embodiment, it is different from the first embodiment in that an ornamental sheet 3 is composed of a first film 8 and a second film 9 pinching an ornament 10 between them and the ornamental sheet 3 is attached to the base 2 of the weak acid bar soap 1.

Actually, pressed flowers or printed materials are used as the ornament 10 pinched into the ornamental sheet 3. Polypropylene film is used as material of the first film 8 and the second film 9 in this embodiment, and its thickness is preferably to set around 0.5~1.0 mm or less. If polypropylene film is used as material of the first film 8 and the second film 9, it will not tear when odd-shaped things, like pressed flowers, are pinched between the films because of their certain level of hardness.

The ornamental sheet 3 is cut into a 5~7 mm larger sized circle than the base 2 of the weak acid bar soap 1, and it is attached to the base 2 of the weak acid bar soap 1 using water. Specifically, surface of the weak acid bar soap 1 is partly dissolved and made to sticky paste when it is moistened by water, so if the ornamental sheet 3 is stuck with pressure in such a state, it clings to the weak acid bar soap 1 without any adhesives and it does not come unstuck. But, it is important to cling tightly, so that no extra moisture remain between the ornamental sheet 3 and weak acid bar soap 1.

In this second embodiment, the waterproof protective film 11 is attached over the ornamental sheet 3, so the weak acid bar soap 1 and the waterproof protective film 11 cannot contact in the part of that the soap where the ornamental sheet 3 and the waterproof protective film 11 are overlapped. However, the waterproof protective film 11 can cling to the weak acid bar soap 1 in the part of that the soap that the ornamental sheet 3 and it are not overlapped, because the waterproof protective film 11 is at least 5~7 mm larger than the ornamental sheet 3, so the whole waterproof protective film 11 can cling to the weak acid bar soap 1 in this part.

According to this second embodiment a greater diversity of ornaments can be added by using pressed flowers or printed materials instead of directly printing on the waterproof protective film 11.

FIG. 4 shows the third embodiment of the weak acid bar soap of the invention. Element 1 of this drawing is the weak acid bar soap and element 3 is the ornamental sheet. In this third embodiment, the ornamental sheet 3, which is composed of the first film 8 and the second film 9 pinching an ornament 10 between them, is itself attached to the base 2 of the weak acid bar soap 1 as a waterproof protective film.

Actually, pressed flowers or printed materials are used as the ornament 10. Polypropylene film is used as material of the first film 8 and the second film 9 in this embodiment, and its thickness is preferably around 0.5~1.0 mm or less. This polypropylene film will not tear when odd-shaped things, like pressed flowers, are pinched between the films because of their certain level of hardness.

The ornamental sheet 3 is cut into 5~7 mm larger sizes than the base 2 of the weak acid bar soap 1. Then, it is preferred that the outer circumference of the ornamental sheet 3 is, for example, cut into an undulant form to increase affinity with the weak acid bar soap 1. The waterproof protective film 11 is attached to the base 2 of the weak acid bar soap 1 using water. Specifically, the surface of the weak acid bar soap 1 is partly dissolved and made into sticky paste when it is moistened by water, so if the ornamental sheet 3 is stuck with pressure in such a state, it clings to the weak acid bar soap 1 without any adhesives and it does not come unstuck. But, it is important to cling tightly, so that no extra moisture remains between the ornamental sheet 3 and weak acid bar soap 1.

The part of the ornamental sheet 3 which extends 5~7 mm beyond the base of the soap is stood up for and clung to the side 4 of the weak acid bar soap 1. In this way, the weak acid bar soap 1 will not dissolve from the base or the lower part of the side 4 and will not form a recess, because from its base 2 to a portion of the side 4 is covered with the ornamental sheet 3. Therefore, soap stands and the soap will not stick to each other, so the soap can be handled and used without difficulty. Thus, waste of the soap is eliminated.

FIG. 5 shows the fourth embodiment of the weak acid bar soap of the invention. In this embodiment, it is different from the third embodiment explained in FIG. 4 only in the first film 8. That is, only the first film 8 is cut into a circle which has the same radius as or a little smaller radius than the base 2. In this way, the outer circumference of the ornamental sheet 3 which is stood up on the side 4 can be thinner, and the uncomfortable feeling that occurs when the soap is used can be relieved.

FIG. 6 shows a process of the weak acid bar soap 1 which is attached to the waterproof protective film 11 dissolving and getting smaller by use. FIG. 6A shows a state of the weak acid bar soap 1 which is partly rounded by dissolving from the upper outer circumference. Furthermore, FIG. 6B shows a state that said weak acid bar soap 1 dissolves by further use and becomes column-shaped with its height equal to the side height of the waterproof protective film 11 covering. As shown above, the weak acid bar soap 1 of the invention is attached to the waterproof protective film 11 on the base and the waterproof protective film 11 is stood up on the side, so it allows for preventing local dissolution and sequentially dissolving from the upper side.

In addition, column-shaped weak acid bar soap 1 was explained in these embodiments for convenience. However, the invention is not limited to this and of course it can be applied for other weak acid bar soaps than column-shaped one. Some of those embodiments will be explained in FIGS. 7, 8, and 9.

FIG. 7 shows a cross-section drawing of the weak acid bar soap 1 which has column-shape as shown above but its corner is round-shaped and is attached to the waterproof protective film 11. FIG. 8 shows a cross-section drawing of the weak acid bar soap 1 which has an approximately spherical shape but has a base and a side which are attached to the waterproof protective film 11. FIG. 9 shows a cross-section drawing of the weak acid bar soap 1 which has a hexagonal cross-section surface which is attached to the waterproof protective film 11.

The weak acid bar soap 1 shown in FIGS. 7, 8, and 9 has different shapes, but it is common that the waterproof protective film 11 covers the side of the weak acid bar soap 1 to a height at which an axial transverse section has maximum external diameter. That is, any shapes the weak acid bar soap 1 has, the effects of this invention can be obtained if the waterproof protective film approximately covers the side of the weak acid bar soap 1 to a height at which an axial transverse section has maximum external diameter.

EXPLANATION OF REFERENCES

Figure 1:
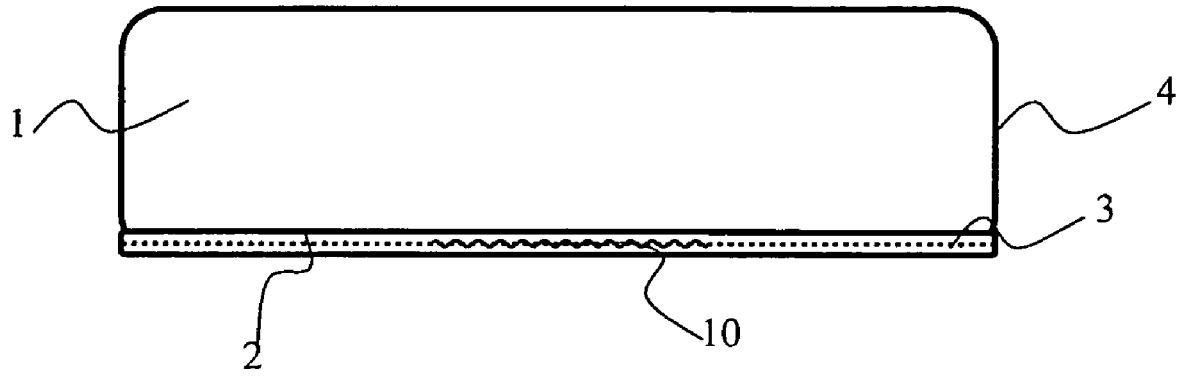
Fig. 1 A (Related Art)
FIGS. 1A-1F are drawings showing dissolution of a conventional weak acid bar soap.
Figure 1:
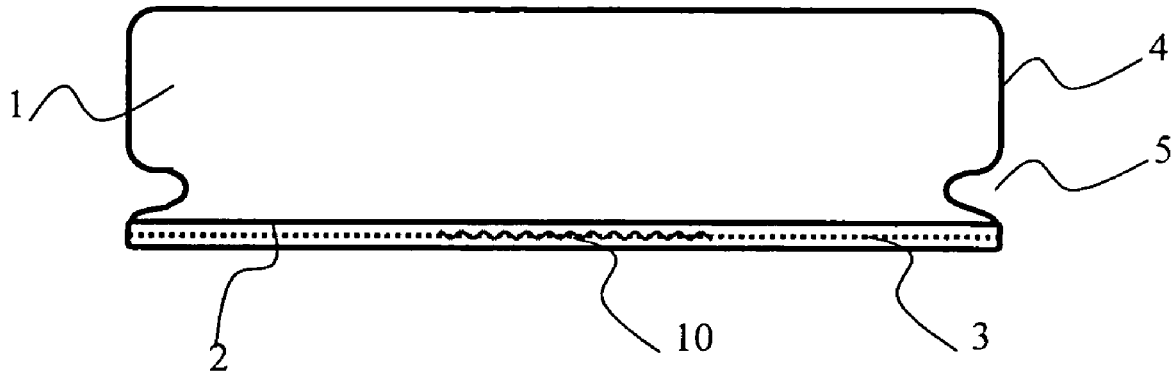
Fig. 1 B (Related Art)
Figure 1:
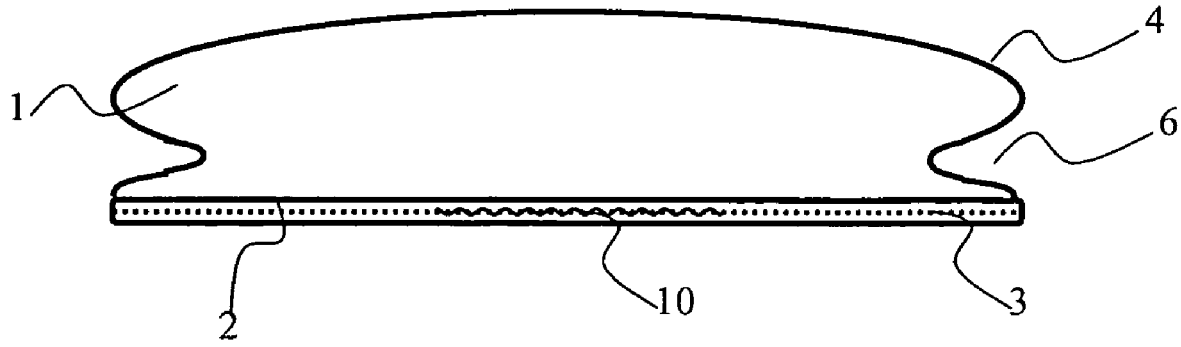
Fig. 1 C (Related Art)
Figure 1:
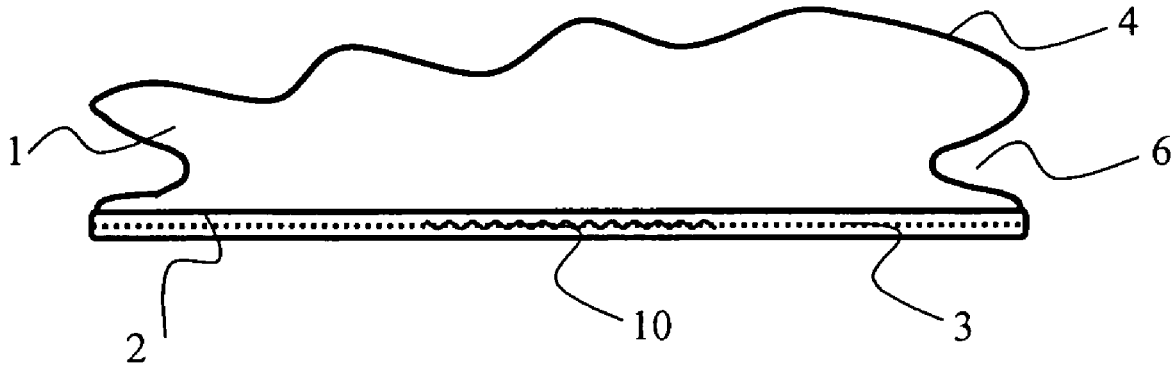
Fig. 1 D (Related Art)
Figure 1:
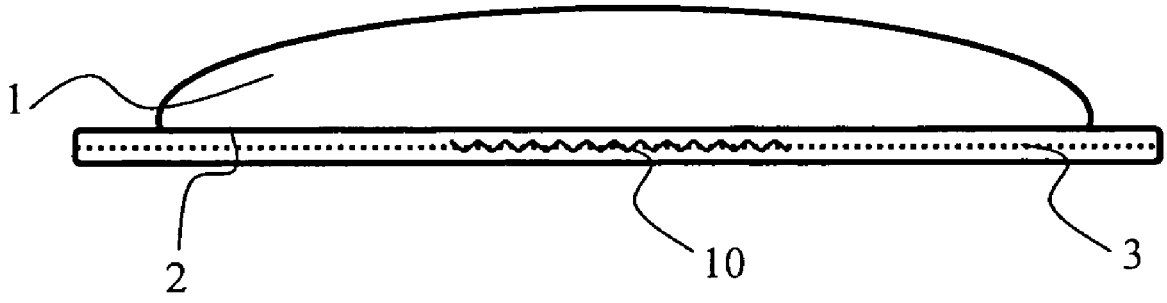
Fig. 1 E (Related Art)
Figure 1:
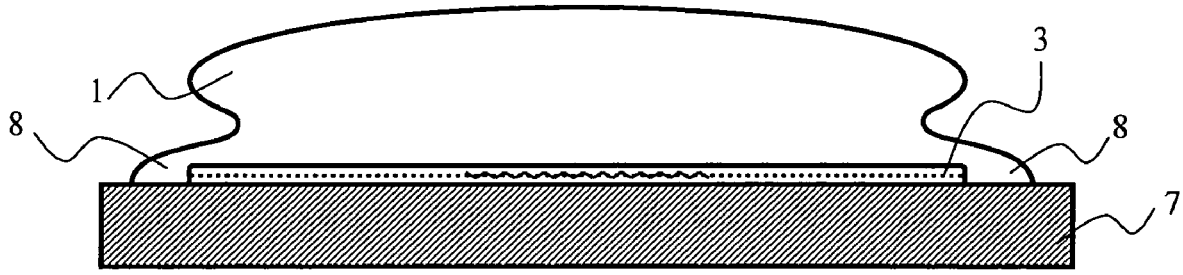
Fig. 1 F (Related Art)
Figure 2A:
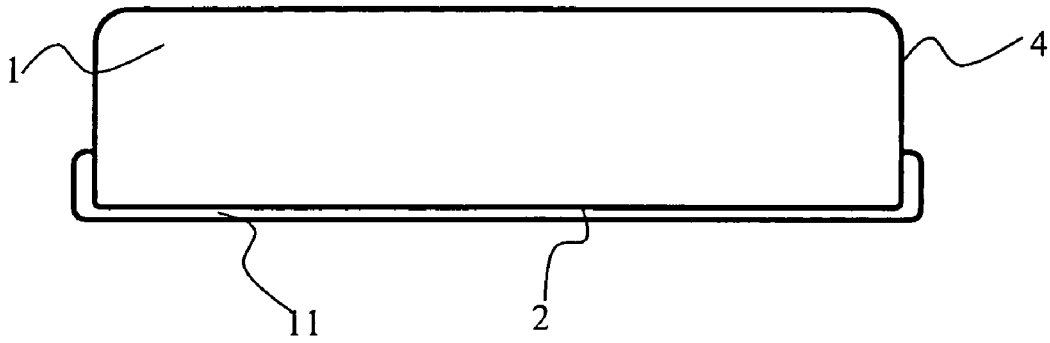
FIGS. 2A and 2B are drawings showing a weak acid bar soap according to the first embodiment of the present invention.
Figure 2B:
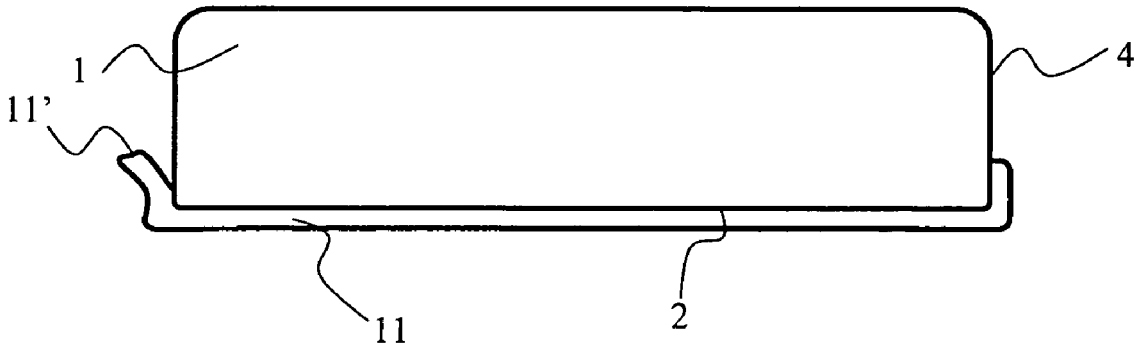
Figure 3:
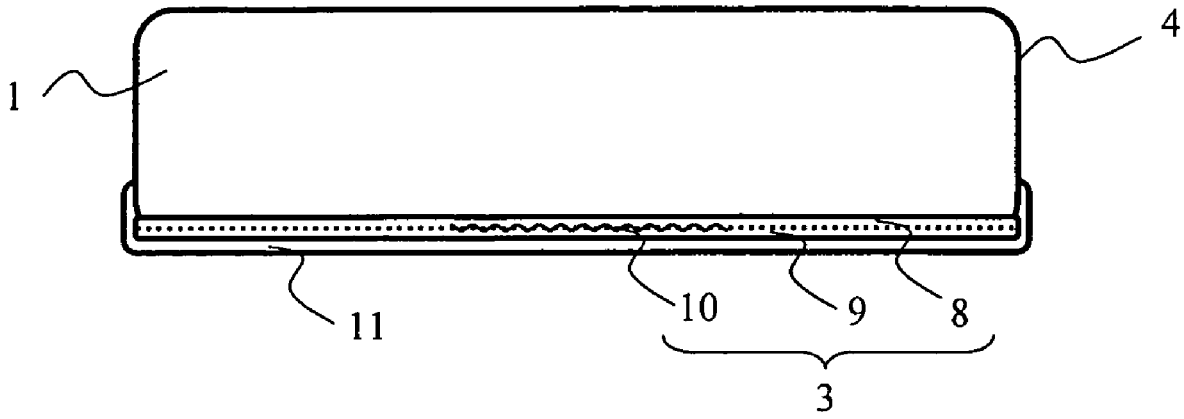
FIG. 3 is a drawing showing a weak acid bar soap according to the second embodiment of the present invention.
Figure 4:
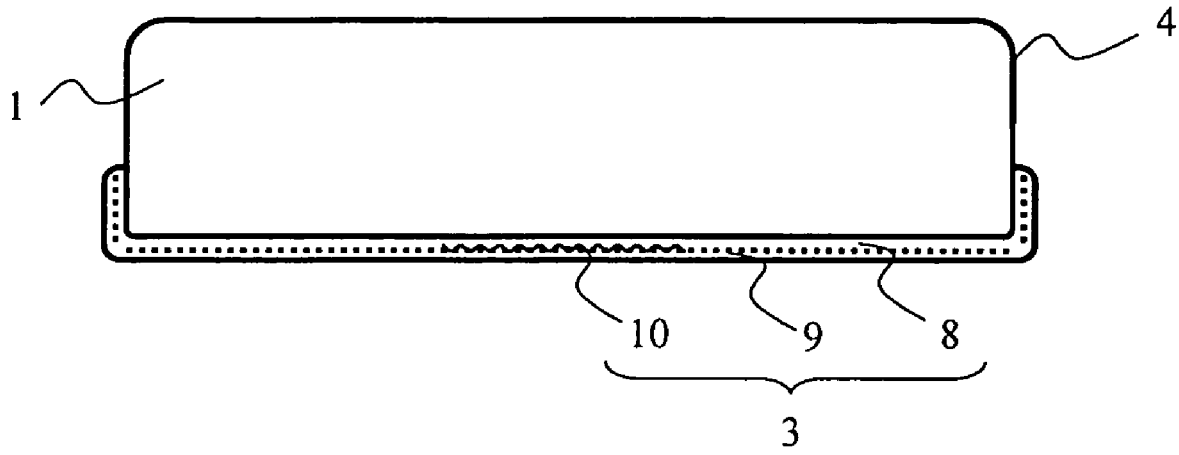
FIG. 4 is a drawing showing a weak acid bar soap according to the third embodiment of the present invention.
Figure 5:
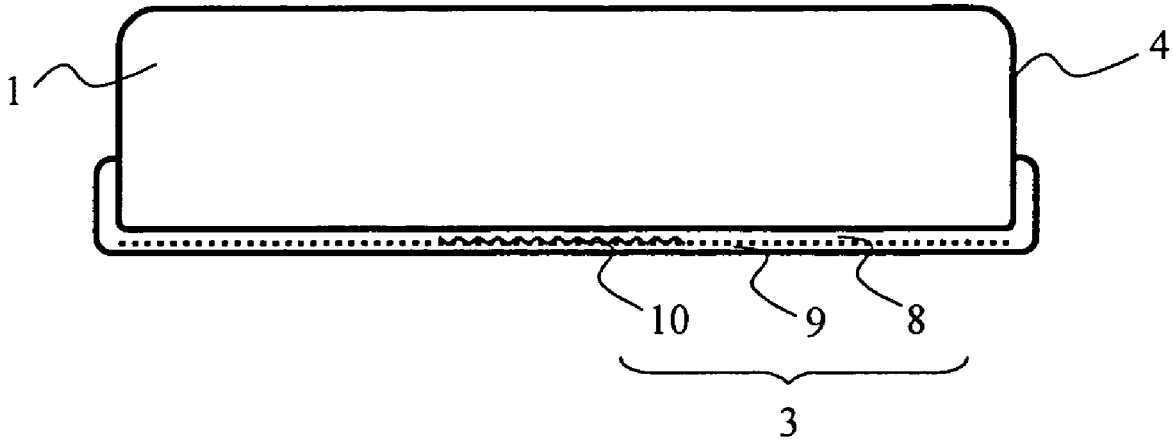
FIG. 5 is a drawing showing a weak acid bar soap according to the fourth embodiment of the present invention.
Figure 6A:
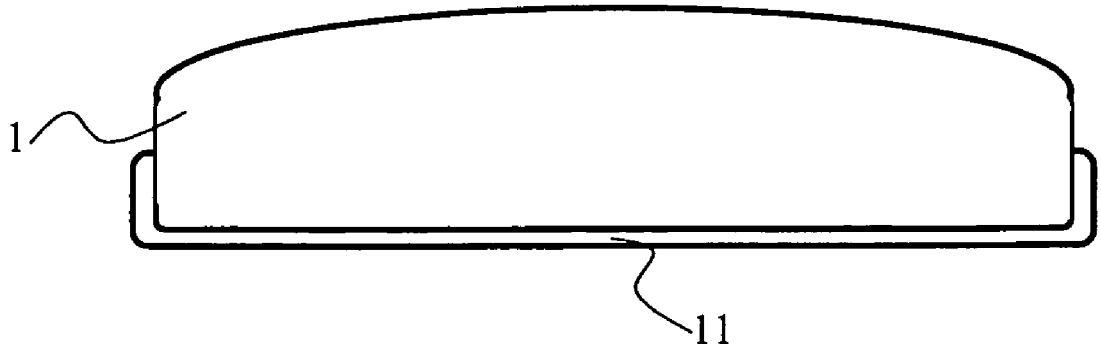
FIGS. 6A and 6B are drawings showing dissolution of a weak acid bar soap according to the present invention.
Figure 6B:
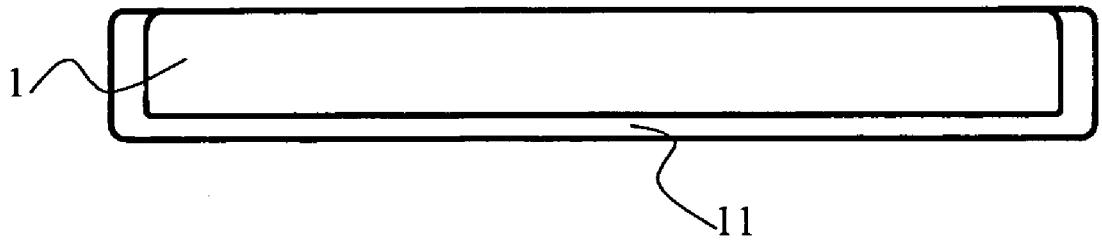
Figure 7:
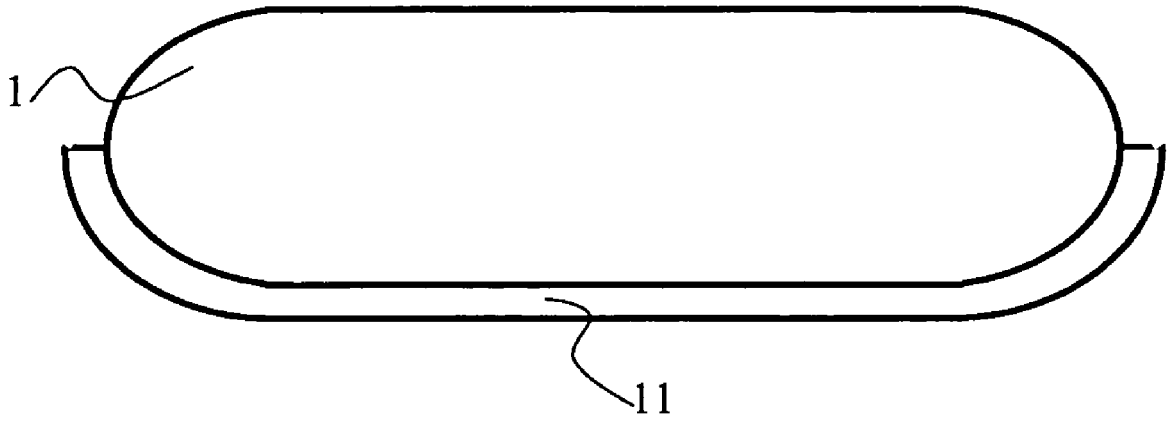
FIG. 7 is a drawing showing a weak acid bar soap not shaped as a cylinder and attached to a waterproof protective film according to the first applied example.
Figure 8:
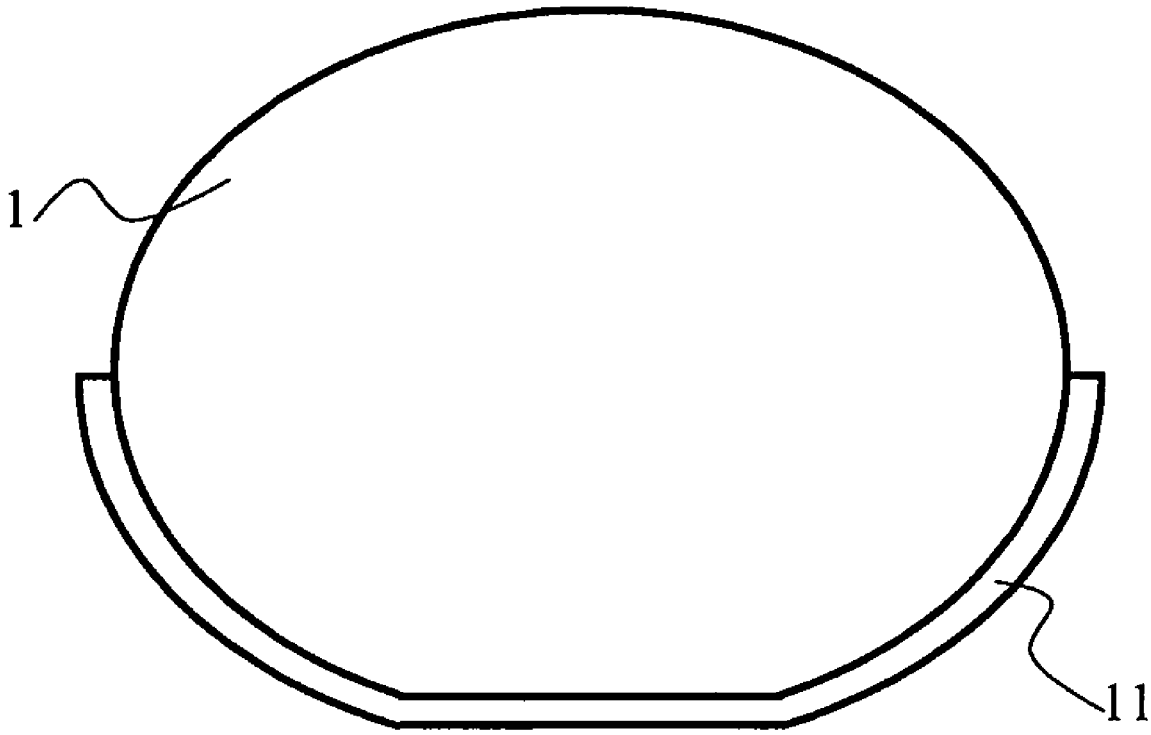
FIG. 8 is a drawing showing a weak acid bar soap not shaped as a cylinder and attached to a waterproof protective film according to the second applied example.
Figure 9:
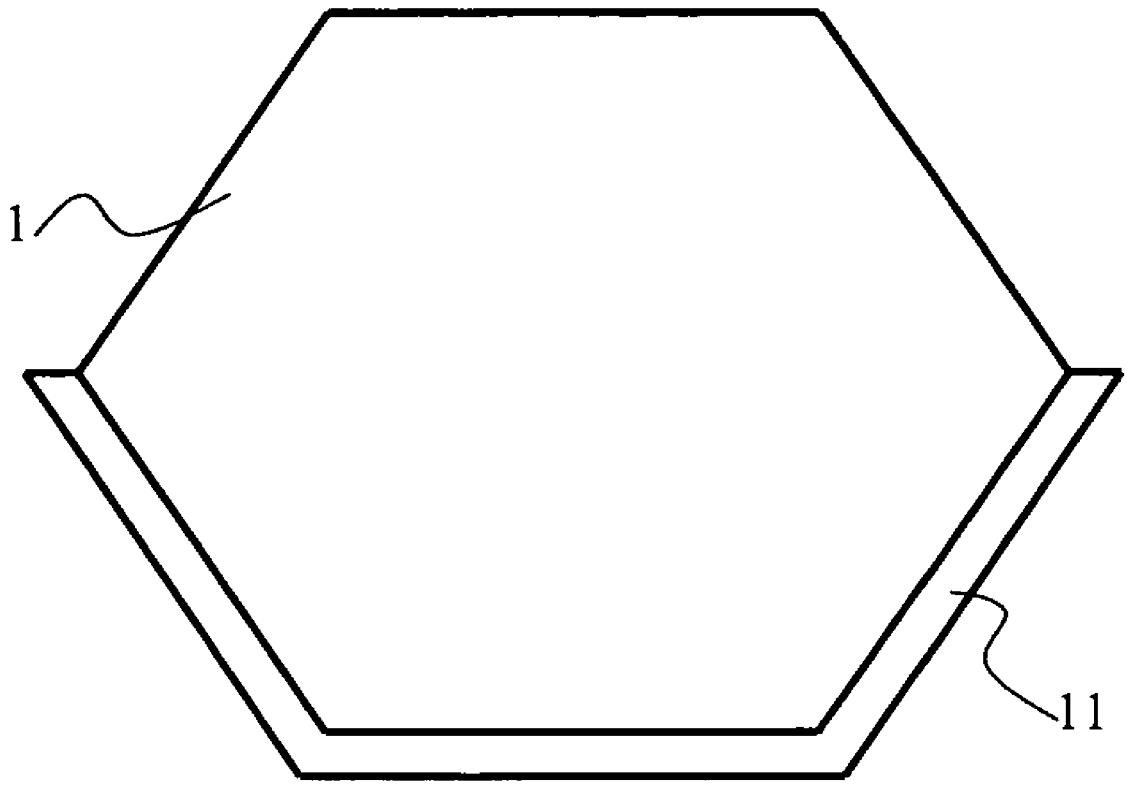
FIG. 9 is a drawing showing a weak acid bar soap not shaped as a cylinder and attached to a waterproof protective film according to the third applied example.

1: weak acid bar soap
2: base
3: ornamental sheet
4: side
5: recess
6: recess
7: soap stand
8: the first film
9: the second film
10: ornament
11: waterproof protective film
11': leading edge of the waterproof protective film

What is claimed is:

1. A weak acid bar soap, comprising:

a body of a weak acid bar soap including N-long-chain acyl acidic amino-acid salt, water, and a transparentizing agent as components, the body of the weak acid bar soap having a base, an upper surface opposite the base, and a side surface connecting the base and the upper surface; and a waterproof protective film attached to said body of said weak acid bar soap such that said waterproof protective film covers said base and at least a lower part of said side surface of said weak acid bar soap, a leading edge of said waterproof protective film being attached to said side surface of said body of said weak acid bar soap;

wherein said transparentizing agent is at least one selected from the group consisting of multiple alcohols, hydrocarbon, thiourea and urea;

wherein said upper surface and a portion of said side surface of said body of said weak acid bar soap is exposed and not covered by said waterproof protective film, and wherein said waterproof protective film and said side surface of said body of said weak acid bar soap stick together tightly so as not to form a gap therebetween to prevent moisture from entering into said gap, such that said lower part of said side surface of said body of said weak acid bar soap is not dissolved by moisture that impinges thereon.

2. The weak acid bar soap according to claim 1, wherein said waterproof protective film is polyethylene film which thickness is from 30 μm and 40 μm.

3. The weak acid bar soap according to claim 1, further comprising an ornament disposed between said base of said weak acid bar soap and said waterproof protective film.

4. The weak acid bar soap according to claim 3, wherein said ornament is an object disposed and sealed between two polypropylene films, and said waterproof protective film is polyethylene film which thickness is from 30 μm and 40 μm.

5. The weak acid bar soap according to claim 1, wherein said waterproof protective film includes an ornament.

6. The weak acid bar soap according to claim 4, wherein said waterproof protective film pinches an ornament between a first polypropylene film, the size of which is the same as or smaller than said base of said weak acid bar soap, and a second polypropylene film, the size of which is slightly larger than said base of said weak acid bar soap; and wherein said second polypropylene film extends to said lower part of said side surface and adheres tightly thereto.

7. The weak acid bar soap according to claim 1, wherein a side of said waterproof protective film which sticks to said weak acid bar soap includes information including characters, patterns, or figures.

8. The weak acid bar soap according to claim 1, wherein said waterproof protective film extends to a height at which said weak acid bar soap has a maximum external diameter.

9. The weak acid bar soap according to claim 1, wherein said waterproof protective film sticks to said side surface of said weak acid bar soap at a position where a cross-section of said weak acid bar soap has a maximum area.

10. The weak acid bar soap according to claim 1, wherein a height of said waterproof protective film stuck to said side of said weak acid bar soap is 5 mm to 7 mm relative to said base of said weak acid bar soap.

11. The weak acid bar soap according to claim 1, wherein said side surface is substantially perpendicular to said base.

12. The weak acid bar soap according to claim 11, wherein said waterproof protective film is polyethylene film which thickness is from 30 μm and 40 μm.

13. The weak acid bar soap according to claim 11, further comprising an ornament disposed between said base of said weak acid bar soap and said waterproof protective film.

14. The weak acid bar soap according to claim 13, wherein said ornament is an object disposed and sealed between two polypropylene films, and said waterproof protective film is polyethylene film which thickness is from 30 μm and 40 μm.

15. The weak acid bar soap according to claim 11, wherein said waterproof protective film includes an ornament.

16. The weak acid bar soap according to claim 14, wherein said waterproof protective film pinches an ornament between a first polypropylene film, the size of which is the same as or smaller than said base of said body of said weak acid bar soap, and a second polypropylene film, the size of which is slightly larger than said base of said body of said weak acid bar soap; and wherein said second polypropylene film extends to said lower part of said side surface of said body of said weak acid bar soap, and adheres tightly thereto.

17. The weak acid bar soap according to claim 11, wherein one side of said waterproof protective film which sticks to said weak acid bar soap includes information including characters, patterns, or figures.

18. The weak acid bar soap according to claim 11, wherein a height of said waterproof protective film stuck to said side surface of said weak acid bar soap is 5 mm to 7 mm relative to said base of said weak acid bar soap.

* * * * *